United States Patent [19]

Sowards

[11] Patent Number: 4,478,420

[45] Date of Patent: Oct. 23, 1984

[54] SOCCER TRAINING AND PRACTICE DEVICE

[76] Inventor: Gregory E. Sowards, 1415 S. Maple, Carthage, Mo. 64836

[21] Appl. No.: 472,072

[22] Filed: Mar. 4, 1983

[51] Int. Cl.[3] ..... A63B 69/00

[52] U.S. Cl. ..... 273/411; 273/342; 273/397; 272/65

[58] Field of Search ..... 273/411, 342, 397; 272/65

[56] References Cited

U.S. PATENT DOCUMENTS 2,823,034 2/1958 Bingham, Jr. ..... 273/411

3,256,021 6/1966 Nissen et al. ..... 273/411 X

*Primary Examiner*—William H. Grieb

*Attorney, Agent, or Firm*—Rogers, Eilers & Howell

[57] ABSTRACT

A soccer training and practice device that comprises a trampoline forming a playing surface in communication with a rebounder, and elastic ball-retaining cords, supported by collapsible safety poles, enclosing the playing surface. The rebounder's sides can be solid or of resilient netting, and the angle of the bottom of the rebounder with the playing surface is adjustable to control ball return speed. The rebounder and ball-retaining cords may be separately provided for addition to an existing trampoline.

20 Claims, 13 Drawing Figures

FIG. 10.
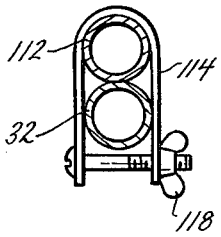
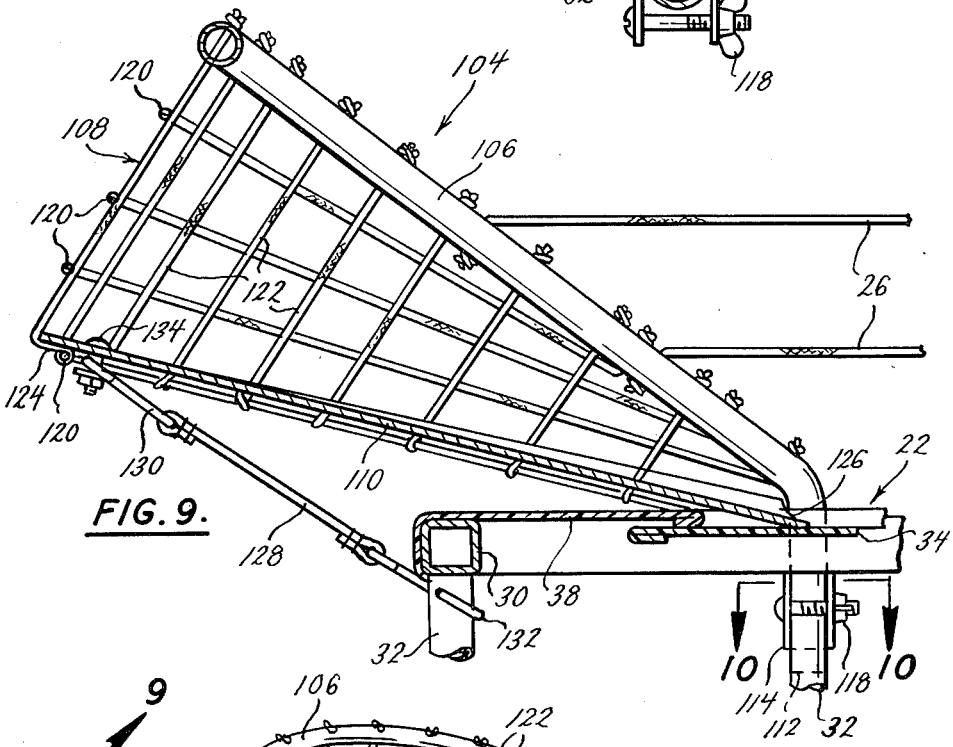
FIG. 9.
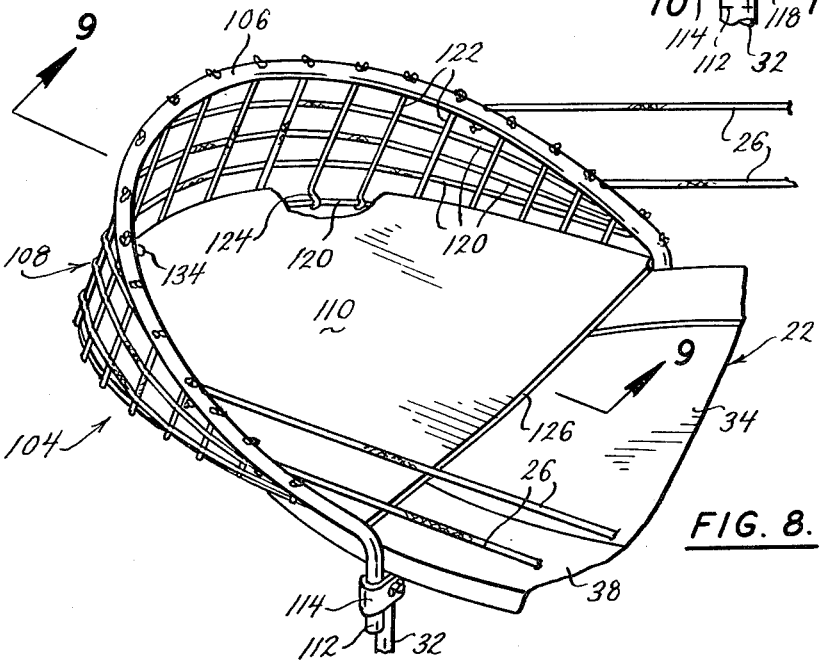
FIG. 8.

SOCCER TRAINING AND PRACTICE DEVICE

BACKGROUND AND SUMMARY OF THE INVENTION

This invention relates to an athletic training device and in particular to a device to develop and maintain the skills important to the play of soccer.

One prior art device for soccer training or practice involved tethering a soccer ball to an anchor in the ground with a length of elastic cord. Such devices presented numerous problems and consequently were of limited utility. The soccer ball and cord apparatus required a large flat area, which limited possible sites and virtually precluded indoor use. The tethering cord had to be securely anchored to the ground. This was typically accomplished by driving an anchoring pin into the ground. This damaged the ground and was unuseable on hard surfaces such as asphalt or cement or indoors. The anchoring device or the cord could cause the user to trip. The tethering cord also had to be secured to the soccer ball. This meant that a normal, regulation soccer ball could not be used and that a special ball provided with an eyelet or similar structure, was required. The tethering structure and the cord would affect the action and motion of the ball, causing it to behave differently than a real soccer ball, thus diminishing the training and practice value of the device. Finally, the elastic cord tether caused a fixed, slow return time that did not adequately simulate real soccer play. The slowness of the tether system did not permit the user to develop the quickness, co-ordination, and ball control crucial to the game.

Another prior art device was a resilient panel or backstop arranged vertically or at a near vertical angle against which the user kicked the ball. This device, too, suffered from numerous problems and consequently was of limited usefulness. Like the soccer ball and cord apparatus, the backstop device required a large flat area, which restricted possible sites and virtually precluded indoor use. Furthermore, since the ball was not tethered or otherwise restricted, use was further limited to areas where an escaped ball would cause no damage. Also, like the soccer ball and cord apparatus, the backstop device provided a slow return time that did not adequately simulate real soccer play. The slowness of the rebounder did not permit the user to develop the quickness, co-ordination, and ball control crucial to the game. The backstop device also had a cumbersome support mechanism which was prone to collapse.

The soccer training and practice device of this invention comprises a rebounding device, the front of which is in communication with a playing surface formed by a trampoline. The rebounder may be co-extensive with the playing surface or an extension therefrom. The rebounder has sidewalls that taper inward toward the rearward, closed end. The sidewalls and back of the rebounder, which can be solid or of resilient netting, preferably form a 90° or less angle with the bottom. The rebounder can be made sturdy but of light weight from molded plastic. The angle of the bottom of the rebounder with the playing surface can be adjusted to thereby control the ball return speed.

This soccer training and practice device simulates real soccer play by having a ball return speed that is adjustable to adapt to the skill of the player. It is useable in a wide range of locations, on any surface, and in a limited space, even indoors. The device is of simple and inexpensive construction, and can be easily retro-fit to a trampoline.

BRIEF DESCRIPTION OF THE DRAWINGS

FIG. 8 is a partial perspective view of a second preferred embodiment of the invention;

FIG. 9 is a cross-sectional view taken along line 9—9 in FIG. 8, showing the construction of the second embodiment and detailing its mounting;

FIG. 10 is a cross-sectional view taken along line 10—10 in FIG. 9 detailing the frame supports;

DESCRIPTION OF THE PREFERRED EMBODIMENT

Figure 1:
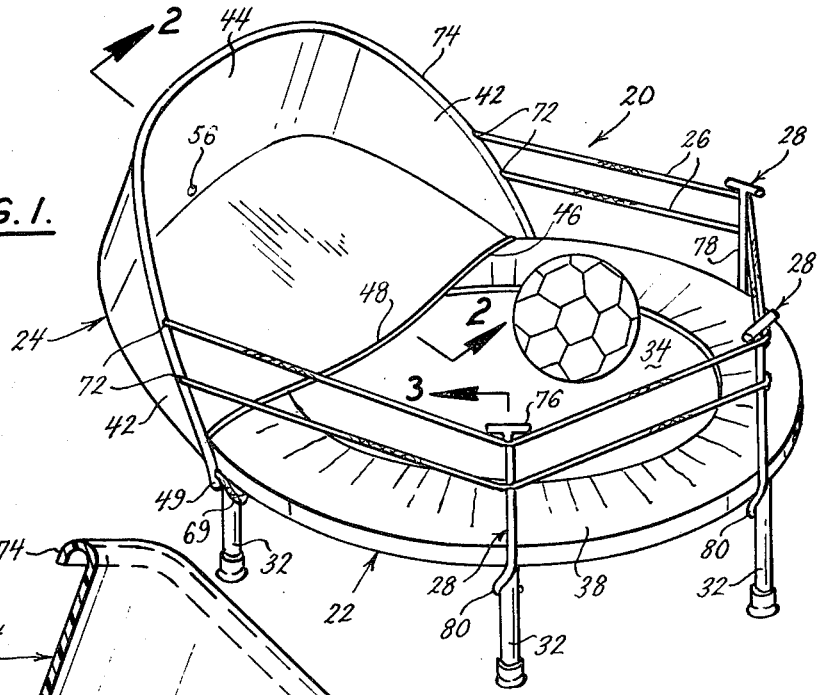
FIG. 1 is a perspective view of a soccer training and practice device showing the rebounder and ball-retaining cords mounted on the trampoline.
Figure 2:
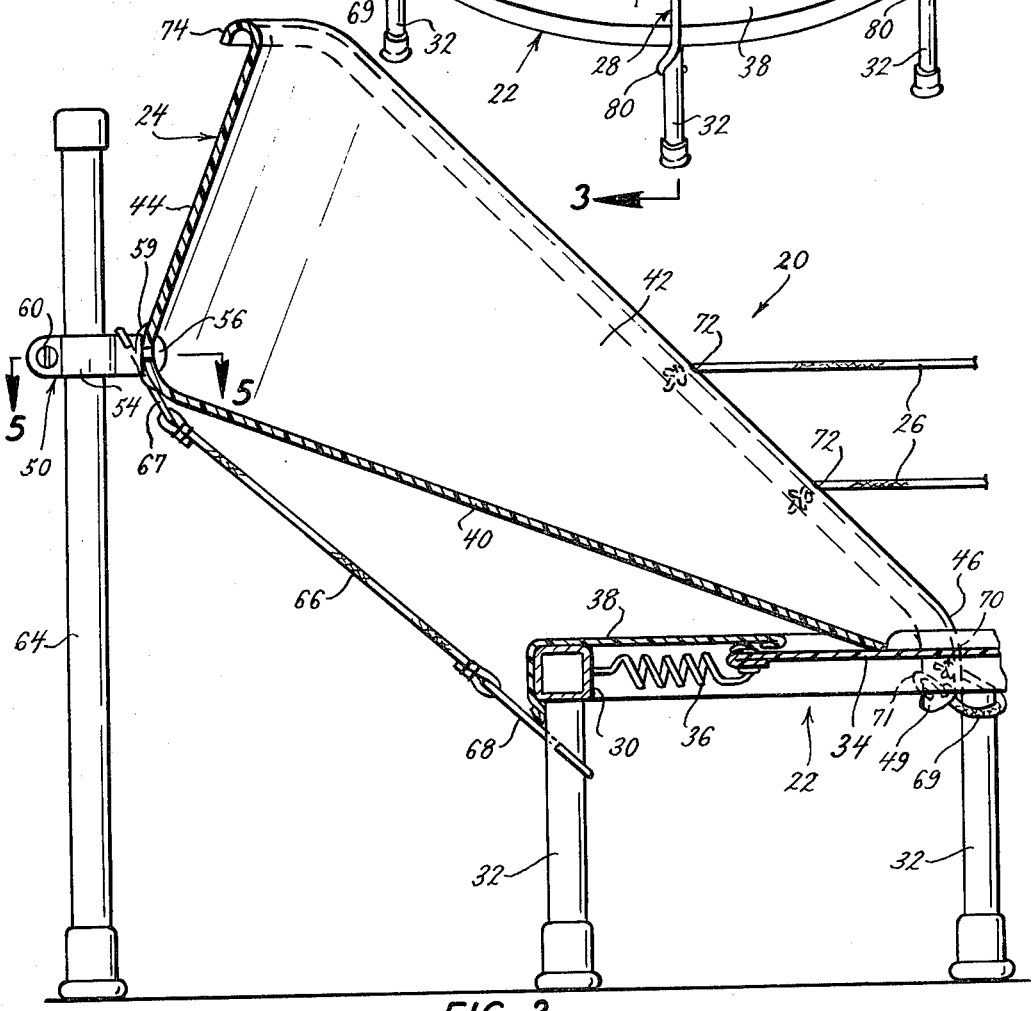
FIG. 2 is a partial cross-sectional view of the rebounder taken along line 2—2 of FIG. 1 and detailing the geometry of the rebounder and its support leg.

The first embodiment 20, as shown in FIGS. 1 and 2 generally comprises a trampoline 22, rebounder 24, elastic ball-retaining cords 26, and a plurality of collapsible safety poles 28. Trampoline 22, as is generally known in the art, comprises frame 30 supported by a plurality of legs 32, a playing surface 34 resiliently supported from frame 30 by a plurality of springs 36, and an apron 38 covering frame 30 and springs 36. Particularly suited to this invention are the round mini-trampolines known in the art. Rebounder 24 has a bottom 40, and two sides 42 that taper inwardly toward backwall 44. It is preferable that sidewalls 42 and backwall 44 form a 90° angle or less with bottom 40 as shown in FIG. 2. The front end 46 of the rebounder communicates with playing surface 34. A special channel 48 in bottom 40 impinges on playing surface 34, facilitating this communication. Lips 49 at the lower, front end of sidewalls 42 engage the frame 30 of trampoline 22. Rebounder 24 can be made of plastic simply and inexpensively by injection molding or vacuum forming. The rebounder can thus be made of light weight but sturdy construction and provided with rounded corners and edges.

Figure 5:
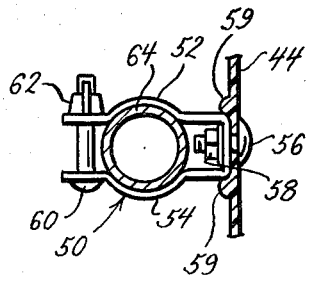
FIG. 5 is a cross-sectional view taken along line 5—5 in FIG. 2 and showing the rear support leg's connection to the rebounder.

As shown in FIG. 2, at the rearward end of rebounder 24, low on the backwall 44 is clamp 50. As shown in FIG. 5 clamp 50 is roughly U-shaped, having sides 52 and 54. Clamp 50 is attached to backwall 44 as by bolt 56 and nut 58. Rotation of clamp 50 is prevented by nubs 59 in backwall 44, disposed in either side of clamp 50. Bolt 60 and wing-nut 62 hold sides 52 and 54 together to frictionally engage support pole 64, thereby supporting the rebounder. The height of the rebounder can thus be adjusted by selecting the desired height and tightening bolt 60 and nut 62 to engage pole 60 at the corresponding height. The rebounder 24 is held against trampoline 22 by elastic cord 66 provided with hooks 67 and 68. Hook 67 engages rebounder 24 at clamp 50, and hook 68 engages trampoline 22, such as by leg 32. In addition to, or instead of, elastic cords 66 the rebounder can be held against trampoline 22 by cords 69 attached to each lip 49 of the rebounder 24, as by knots 70. The cord 69 encircles a leg 32 of trampoline 22 and hook 71 on the free end of cord 69 closes the loop by engaging either the cord 69 or lip 49.

Ball-retaining cords 26 enclose the playing surface 36, and are preferably made of a resilient material. Each end of the cords 26 passes through holes 72 in the sidewall 42 of the rebounder and is knotted under rim 74.

Figure 4:
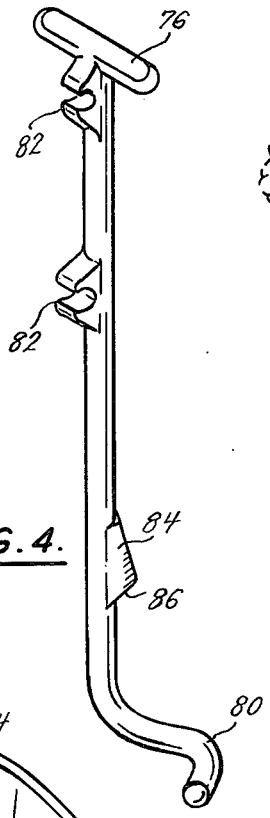
FIG. 4 is a perspective view of the collapsible safety poles of FIG. 3.
Figure 3:
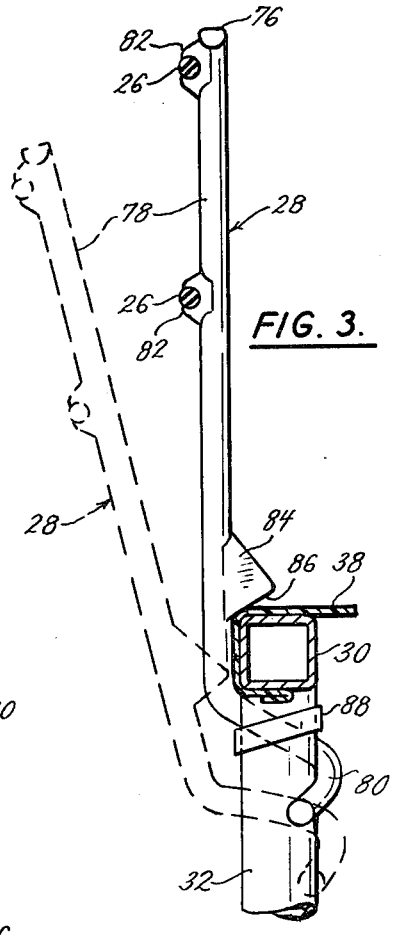
FIG. 3 is a side view taken along line 3—3 in FIG. 1 showing the collapsible safety poles that support the ball-retaining cords and their mounting to the trampoline.

The ball-retaining cords 26 are supported about the playing surface by a plurality of collapsible safety poles 28, which are best shown in FIGS. 3 and 4. The poles 28 comprise a blunt, T-shaped top 76, a shaft 78, and a helical bottom 80. Two clips 82, axially spaced on the external side of shaft 78, engage the ball-retaining cords 26. A tab 84, with upward angled bottom 86, is located on the internal side of shaft 78 near helical bottom 80.

As best shown in FIG. 3, the helical bottom 80 of pole 28 encircles and thereby engages a leg 32 of trampoline 22. Bottom 86 of tab 84 engages the top of frame 30 of trampoline 22, to support the pole. The poles 28 are held in place by the tension of the cords 26 running between them. Tab 84 can be left off pole 28, in which case pole 28 is supported by the frictional engagement between frame 30 and shaft 78 as shaft 78 is urged against frame 30 by the tension of cords 26 running between the poles 28. In either case, resilient band 88 can also be used to hold helical bottom 80 to leg 32.

Outward motion of poles 28 is flexibly resisted by the helical structure of bottom 80 assisted by cords 26 and resilient band 88. Downward motion of pole 28 is permitted by angled bottom 86 of tab 84, which, upon downward pressure, moves tab 84 out of engagement with frame 30 of trampoline 22, so that the pole 28 can slide down leg 32. Of course where no tab 84 is provided, the pole 28 is still free to slide down leg 32 upon downward pressure.

Figure 7:
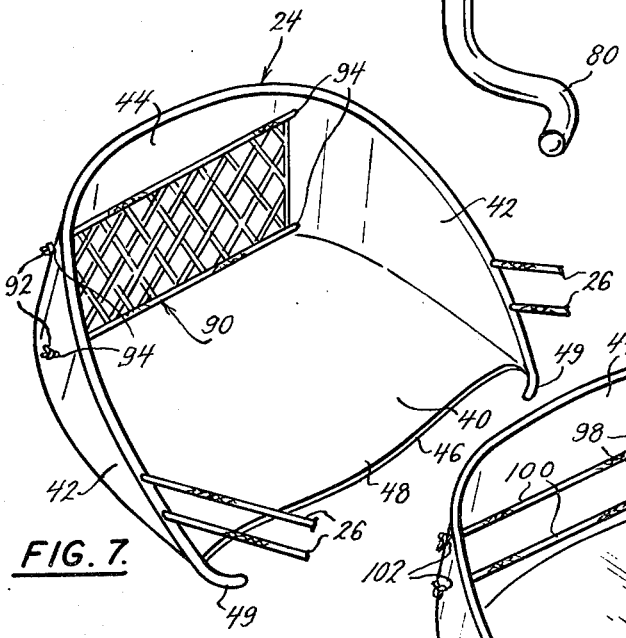
FIG. 7 is a perspective view of a second modification to the first embodiment utilizing netting inside the rebounder.

A modification to the first preferred embodiment is shown in FIG. 7. There, rebounder 24 is provided with resilient netting 90 parallel to backwall 44. Tabs 92 on netting 90 pass through opposing holes 94 in sidewalls 42 and are knotted on the external sides of sidewalls 42 to hold the netting in place.

Figure 6:
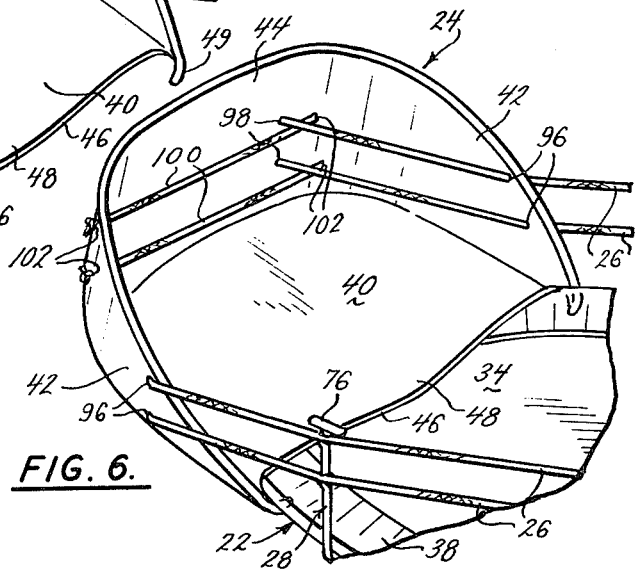
FIG. 6 is a perspective view of a first modification to the first embodiment utilizing resilient cords inside the rebounder.

A second modification to the first preferred embodiment is shown in FIG. 6. There, ball-retaining cords 26 do not end in knots under rim 74 of sidewalls 42, but instead pass through holes 96 in sidewalls 42 and continue inside the rebounder, passing out holes 98 in the backwall 44, and terminating in knots (not shown). Two resilient cords 100 run between sidewalls 42 parallel to and near backwall 44. Cords 100 pass through opposing holes 102 in sidewalls 42 and are knotted on the external side of the rebounder.

A second preferred embodiment is shown in FIGS. 8 and 9. The trampoline 22, ball-retaining cords 26, and collapsible safety poles 28 are as described in the first embodiment, but a new rebounder 104 is provided. Rebounder 104 comprises generally U-shaped rib 106, netting 108, and a bottom board 110. Ball retaining cords 26 are knotted to rib 106.

Each end 112 of rib 106 is attached to a leg 32 of trampoline 22 by a U-shaped clamp 114, as shown in cross-section in FIG. 10. Clamp 114 encircles leg 32 and rib end 112, and binds them together when wing-nut 118 is tightened.

Netting 108 comprises horizontal strands 120, each end of which is knotted to rib 106, and vertical strands 122, the top ends of which are knotted to rib 106. The bottom-most horizontal strand 120, which engages the bottom ends of vertical strands 122, is shorter than the others to create a lip 124 to engage rebounder bottom board 110.

The corners of front edge 126 of bottom board 110 engage rib 106. Bottom board 110 is also connected to the trampoline with cord 128 which has hooks 130 and 132 at the ends. Hook 130 engages nut and bolt 134 provided in the rear of the bottom board 110, and hook 132 engages the trampoline such as by leg 32.

Figure 11:
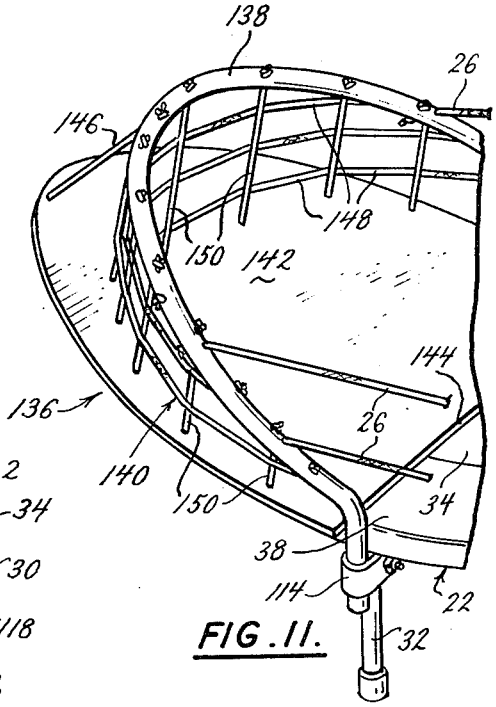
FIG. 11 is a partial perspective view of a third preferred embodiment of the invention.
Figure 12:
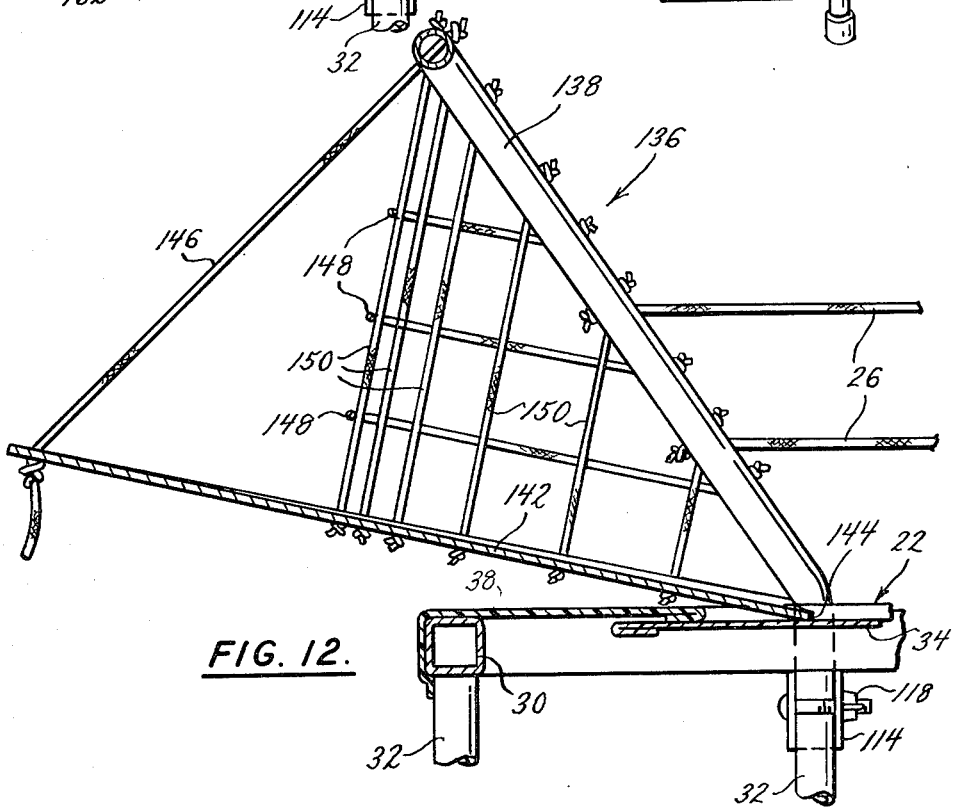
FIG. 12 is a cross-sectional view of the third embodiment showing its construction and detailing its mounting.

A third preferred embodiment is shown in FIGS. 11 and 12. In this embodiment the trampoline 22, ball-retaining cords 26, and collapsible safety poles 28 are as described in the first two embodiments, but a new rebounder 136 is provided. Rebounder 136 comprises a generally U-shaped rib 138, netting 140, and bottom board 142. Ball retaining cords 26 are knotted to rib 138. Each end of rib 138 is attached to a leg 32 of trampoline 22 by a U-shaped clamp 114, shown in cross-section in FIG. 10 and described above.

The corners of the front edge 144 of bottom board 142 engage rib 138. The rear end of bottom board 142 is adjustably supported from rib 138 by cord 146, one end of which passes through rib 138 and is knotted at the top, and the other end of which passes through bottom 142 and is knotted on the underside.

Netting 140 comprises horizontal strands 148, each end of which is knotted to rib 138, and vertical strands 150, the top ends of which are knotted to rib 138, and the bottom ends of which are knotted to bottom 142.

Figure 13:
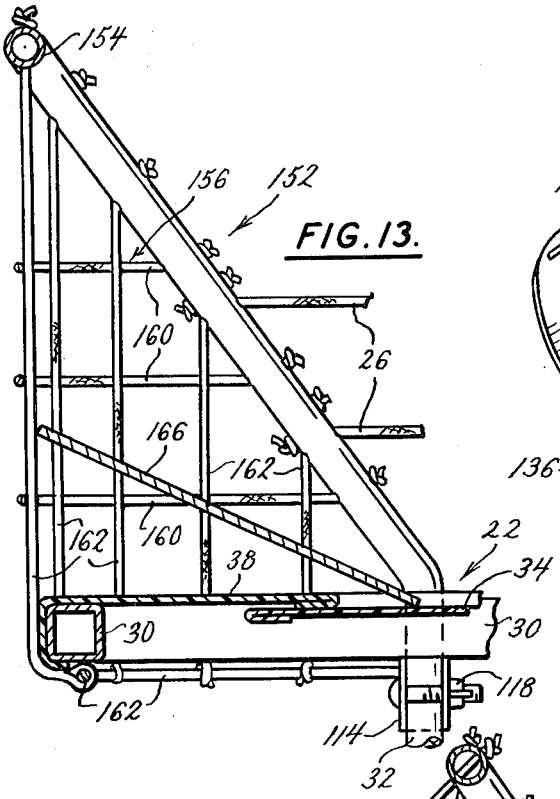
FIG. 13 is a cross-sectional view of the fourth embodiment showing its construction and detailing its mounting.

The rebounder 152 of a fourth preferred embodiment is shown in cross-section in FIG. 13. Again, the trampoline 22, the ball-retaining cords 26, and collapsible safety poles 28 are as described for the other preferred embodiments. Rebounder 152 comprises rib 154 and netting 156. Ball retaining cords 26 are knotted to rib 154. Each end 158 of rib 154 is attached to a leg 32 of trampoline 22 by a U-shaped clamp 114, shown in cross section in FIG. 10 and described above.

Netting 156 comprises horizontal strands 160, each end of which is knotted to rib 154, a net retention cord 162, each end of which is knotted to rib 154 and which passes under frame 30 of trampoline 22, and vertical strands 164, the lower ends of which are looped around net retention cord 162 and the upper ends of which are knotted to rib 154.

Bottom board 166 fits in the rebounder, the corners of front end 168 engage rib 154 and the back end is engaged by and supported by netting 156.

In each of the preferred embodiments and modifications, the user positions himself on the playing surface 34 which, because of its resiliency, allows the user to stand or to simulate running or jogging. The user kicks the ball in the rebounder from the playing surface, which returns it to the user. Balls that escape the user's control are retained on the playing surface by the ball retaining cords supported around the periphery of the playing surface by collapsible safety poles. The blunt, T-shaped top of the poles also help to prevent injury to the user.

The cords and poles resist the buffetting of soccer ball, but because of the helical structure of the bottom of the poles and the resiliency of the cords they freely yield to outward pressure caused by a user falling against them. Similarly, the poles normally firmly engaging the trampoline with tab 84, because of the angular configuration of the tab bottom 86, move out of engagement with the trampoline and slide down leg 32 in response to downward pressure caused by a user falling against them. This helps to prevent the user from becoming tangled in the cords or hurt by the poles.

In the first, third and fourth embodiments the ball return speed is adjustable by varying the angle of the bottom of the rebounder with the playing surface. In the first preferred embodiment this is accomplished by adjusting the height of the back of the rebounder on support pole 64 with clamp 50. In the first embodiment, ball return speed can also be increased by putting resilient cords or netting in the rebounder as shown in FIGS. 6 and 7. In the third preferred embodiment the adjustment is accomplished by shortening the support cord 146 that depends from rib 138 and supports the rear of the rebounder bottom. In the fourth preferred embodiment this is accomplished simply by manipulating the rebounder bottom to a higher position, since the bottom is frictionally supported by the netting.

Various changes and modifications could be made to the invention as would be apparent to one of ordinary skill in the art in light of this disclosure. However, those changes and modifications are part of the invention which is limited only by the scope of the claims appended hereto.

What is claimed is:

1. A soccer training and practice device comprising:

a trampoline having a resilient surface forming a playing surface;

ball-rebounding means in communication with the playing surface, the ball-rebounding means having a bottom, a backwall at the rear of the bottom, and two sidewalls, one on each side of the bottom and defining an open front communicating with the playing surface, the bottom being inclined with respect to the playing surface so that a ball propelled into the ball-rebounding means from the playing surface has a tendency to return thereto.

2. The device of claim 1 further comprising ball-retaining means enclosing the playing surface.

3. The device of claim 1 wherein the ball-rebounding means is a piece molded plastic unit.

4. The device of claim 1 further comprising means to adjust the angle between the bottom of the ball-rebounding means and the playing surface.

5. The device of claim 4 wherein the means to adjust the angle between the bottom of the ball-rebounding means and the playing surface comprises a support rod and a clamp for adjustably engaging the ball-rebounding means to the support rod at a desired height.

6. A soccer training and practice device comprising:

a trampoline having a resilient surface forming a playing surface; and, ball-rebounding means in communication with the playing surface, the ball-rebounding means comprising a generally U-shaped rib, means securing each end of the rib to the trampoline so that the open end of the "U" of the rib faces the playing surface, netting depending from the rib, and a bottom having a flat front side and a round rear side, the netting depending downwardly from the rib engaging and at least partially supporting the bottom along its circumference, the corners of the flat front side of the bottom engaging the rib.

7. The device of claim 6 wherein the ball-rebounding means further comprises means to adjust the angle between the bottom and the playing surface.

8. The device of claim 7 wherein the means to adjust the angle between the bottom and playing surface comprises a cord of adjustable length depending from the rib and supporting the rear side of the bottom, so that by varying the length of the adjustable cord the angle of the bottom with the playing surface can be adjusted.

9. The device of claim 6 further comprising ball-retaining means enclosing the playing surface.

10. A soccer training and practice device comprising:

a trampoline having a resilient surface forming a playing surface;

ball-rebounding means in communication with the playing surface; and, ball-retaining means enclosing the playing surface the ball-retaining means comprising at least one resilient band attached at one end to one side of the ball-rebounding means, passing around the periphery of the playing surface, and attached at the other end to the other side of the ball-rebounding means, and a plurality of poles mounted about the periphery of the playing surface supporting the resilient band.

11. The device of claim 10 wherein the trampoline has a frame supported by a plurality of legs and wherein the poles comprise a shaft, a blunted top on the shaft, means on the shaft for engaging the ball-retaining means, a helical end on the shaft opposite the blunted top encircling and thereby engaging a leg of the trampoline such that outward motion is flexibly resisted and downward pressure on the pole causes the pole to slide down the leg of the trampoline.

12. A soccer training and practice device adapted for mounting to a trampoline, the trampoline having a resilient surface on a frame supported by a plurality of legs, said resilient surface acting as a playing surface, said device comprising:

ball-rebounding means, the ball-rebounding means comprising a bottom, a back adjacent thereto, and two sides tapering inwardly toward the back and defining an open front adapted to communicate with the playing surface when mounted thereto;

means to mount the ball-rebounding means to said trampoline so that balls projected into the ball-rebounding means from the playing surface tend to return to the playing surface;

ball-retaining means; and, means to mount the ball-retaining means about the periphery of the playing surface to retain the ball thereon.

13. A soccer training and practice device adapted for mounting to a trampoline, the trampoline having a resilient surface on a frame supported by a plurality of legs, said resilient surface acting as a playing surface, said device comprising:

ball-rebounding means;

means to mount the ball-rebounding means to said trampoline so that balls projected into the ball-rebounding means from the playing surface tend to return to the playing surface;

ball-retaining means;

means to mount the ball-retaining means about the periphery of the playing surface to retain the ball thereon; and, means to adjust the angle between the bottom of the ball-rebounding means and the playing surface comprising a support rod and a clamp for adjustably engaging the ball-rebounding means to the support rod at a desired height.

14. A soccer training and practice device adapted for mounting to a trampoline, the trampoline having a resilient surface on a frame supported by a plurality of legs, said resilient surface acting as a playing surface, said device comprising:

ball-rebounding means, the ball-rebounding means comprising a generally U-shaped rib with the open end of the "U" of the rib facing the playing surface when mounted thereto, netting depending from the rib, and a bottom having a flat front side and a round rear side, the netting depending downwardly from the rib engaging and at least partially supporting the bottom along its circumference, the corners of the flat front side of the bottom engaging the rib means to mount the ball-rebounding means to said trampoline so that balls projected into the ball-rebounding means from playing surface tend to return to the playing surface;

ball-retaining means; and, means to mount the ball-retaining means about the periphery of the playing surface to retain the ball thereon.

15. The device of claim 14 having the means to adjust the angle between the bottom and playing surface comprising a cord of adjustable length depending from the rib and supporting the round rear side of the bottom, so that by varying the length of the adjustable cord the angle of the bottom with the playing surface can be adjusted.

16. A soccer training and practice device adapted for mounting to a trampoline, the trampoline having a resilient surface on a frame supported by a plurality of legs, said resilient surface acting as a playing surface, said device comprising:

ball-rebounding means;

means to mount the ball-rebounding means to said trampoline so that balls projected into the ball-rebounding means from the playing surface tend to return to the playing surface;

ball-retaining means; and, means to mount the ball-retaining means about the periphery of the playing surface to retain the ball thereon, the means to mount the ball-retaining means comprising a plurality of poles comprising a shaft, a blunted top on the shaft, means on the shaft for engaging the ball-retaining means, a helical end on the shaft opposite the blunted top encircling and thereby engaging the leg of the trampoline such that outward motion is flexibly resisted, and a tab having an angled lower surface engaging the trampoline frame such that downward pressure on the pole causes the tab to slip out of engagement with the trampoline frame permitting the pole to slide down the leg of the trampoline.

17. A soccer training and practice device adapted for mounting to a trampoline, the trampoline having a resilient surface on a frame supported by a plurality of legs, said resilient surface acting as a playing surface, said device comprising:

a ball-rebounding means having a bottom, a back adjacent thereto, and two sides tapering inward toward the back and defining an open front;

means to mount the ball rebounding means to the trampoline and in communication therewith, so that balls projected into the ball-rebounding means from the playing surface tend to return to the playing surface;

ball-retaining means;

means to mount the ball-retaining means about the periphery of the playing surface to retain the ball thereon comprising a plurality of poles having a shaft, a blunted top on the shaft, means on the shaft for engaging the ball-retaining means, a helical end on the shaft opposite the blunted top encircling and thereby engaging a leg of the trampoline such that outward motion is flexibly resisted, and a tab having an angled lower surface engaging the trampoline frame such that downward pressure on the pole causes the tab to slip out of engagement with the trampoline frame permitting the pole to slide down the leg of the trampoline.

18. The device of claim 17 wherein the ball-rebounding means is made of molded plastic.

19. The device of claim 17 further comprising means to adjust the angle between the bottom of the ball-rebounding means and the playing surface.

20. The device of claim 17 wherein the ball-rebounding means comprises a generally U-shaped rib with the open end of the "U" facing the playing surface when mounted thereto, netting depending from the rib forming the back and sides, and wherein the bottom has a flat front side and a round rear side, the corners of the flat front side engaging the rib and the round rear side engaged by and at least partially supported by the netting.

* * * * *